US011536043B2

(12) United States Patent
Konczak et al.

(10) Patent No.: US 11,536,043 B2
(45) Date of Patent: Dec. 27, 2022

(54) MODULAR MINI BUILDING SYSTEM FOR PARKING LOTS

(71) Applicant: Jeffrey J. Konczak, Alpena, MI (US)

(72) Inventors: Jeffrey J. Konczak, Alpena, MI (US); Kevin Stevens, Ossineke, MI (US)

( * ) Notice: Subject to any disclaimer, the term of this patent is extended or adjusted under 35 U.S.C. 154(b) by 0 days.

(21) Appl. No.: 16/207,370

(22) Filed: Dec. 3, 2018

(65) Prior Publication Data

US 2021/0293042 A1 Sep. 23, 2021

Related U.S. Application Data

(60) Provisional application No. 62/714,824, filed on Aug. 6, 2018.

(51) Int. Cl.
*E04H 3/02* (2006.01)
*G09F 23/00* (2006.01)

(52) U.S. Cl.
CPC ..... *E04H 3/02* (2013.01); *G09F 23/00* (2013.01)

(58) Field of Classification Search
CPC .. E04H 3/02; E04H 1/00; E04H 1/005; E04H 1/12; E04H 2001/1283; G09F 23/00; G09F 15/00; G09F 15/0006; E04B 1/343; E04B 1/348; E04B 1/34861; E04B 1/34336
USPC ..... 52/79.1, 79.2, 79.3, 79.7, 79.8
See application file for complete search history.

(56) References Cited

U.S. PATENT DOCUMENTS

D112,954 S 1/1939 Mdrich et al.
D191,350 S 9/1961 Horvat
3,312,024 A * 4/1967 Paschmann ..... E04B 1/18 52/220.2
D211,080 S 5/1968 Shelstad
D219,577 S 12/1970 Fiedler
D220,170 S 3/1971 Criswell et al.
3,679,177 A * 7/1972 Scholz ..... E04G 21/16 254/89 R (Continued)

FOREIGN PATENT DOCUMENTS

CH 302484864 6/2013
FR 2104992-001 10/2010
JP D1493775 3/2014

OTHER PUBLICATIONS

The Human Bean Franchise Modular Building; https://www.youtube.com/watch?v=1P6CVpPzd6Y; uploaded Mar. 16, 2017; accessed Dec. 3, 2021 (Year: 2017).*

(Continued)

*Primary Examiner* — James M Ference
(74) *Attorney, Agent, or Firm* — Dickinson Wright PLLC

(57) ABSTRACT

A small modular building system and method for establishing a small scale retail business in an existing parking lot. The building system includes three building modules sized to fit on two trailers, which when assembled form a building with a one-story main service area and an attached tower with a lower story bathroom and an upper story mechanicals/utility room above the bathroom. A further component of the system is a rigid carport arch dimensioned to fit in complementary fashion with one or more of the building modules onto the delivery trailer. A method is also disclosed for delivering, assembling, and installing the modules in an existing parking lot to form a functional, well-anchored building with minimal disruption to the parking lot.

11 Claims, 13 Drawing Sheets

(56) References Cited

U.S. PATENT DOCUMENTS 3,703,058 A * 11/1972 Klett ..... E04B 1/34823 52/79.13
3,707,811 A * 1/1973 Hampson ..... E04B 1/10 52/23
D227,356 S 6/1973 Winter
3,745,730 A * 7/1973 Layne ..... E04B 1/0007 52/236.9
3,782,063 A * 1/1974 Batorewicz ..... E04B 1/161 52/63
3,848,376 A * 11/1974 Elmore ..... E02D 27/50 52/169.1
4,012,871 A * 3/1977 Netto ..... E04B 1/34861 52/79.4
4,048,769 A * 9/1977 van der Lely ..... E04B 1/34823 52/79.7
4,050,215 A * 9/1977 Fisher ..... E04B 1/34815 52/79.3
4,124,964 A * 11/1978 Juriss ..... E04B 1/02 52/745.03
4,194,339 A * 3/1980 Fisher ..... E04B 1/34823 52/223.1
4,275,533 A * 6/1981 Wright ..... E04B 1/34336 52/143
D266,592 S 10/1982 Bavis
4,439,957 A * 4/1984 Raasakka ..... E04B 1/34838 52/210
4,441,286 A * 4/1984 Skvaril ..... E04B 1/34815 52/234
4,501,098 A * 2/1985 Gregory ..... E04H 1/02 52/143
D283,166 S 3/1986 Gardner
4,573,292 A * 3/1986 Kaufman ..... E04B 1/34336 52/125.2
4,599,829 A * 7/1986 DiMartino, Sr. ..... E04B 1/3483 410/79
4,723,383 A 2/1988 Jenn
4,779,514 A * 10/1988 Prigmore ..... E04B 1/3445 52/79.5
5,039,256 A * 8/1991 Gagliano ..... E02D 5/54 405/244
5,044,134 A * 9/1991 Brockway ..... E04B 1/24 52/79.1
5,052,519 A * 10/1991 Woodham ..... E05G 7/008 186/37
5,109,956 A * 5/1992 Casale ..... A47J 27/14 186/41
5,152,639 A * 10/1992 Visconti ..... E02D 5/385 405/233
5,353,558 A * 10/1994 Shea, Sr. ..... E04B 1/34336 52/143
D354,815 S 1/1995 Hassett
5,463,833 A * 11/1995 Banez ..... E04B 1/344 52/69
5,613,331 A * 3/1997 LaGanke ..... E04H 5/06 52/169.7
D385,042 S 10/1997 Cooke
5,706,615 A * 1/1998 Bridges ..... E04B 1/3442 52/105
5,727,352 A * 3/1998 Bared ..... E04H 3/04 52/33
D434,155 S 11/2000 Webb
6,237,290 B1 * 5/2001 Tokimoto ..... G09F 19/226 52/236.3
6,240,684 B1 * 6/2001 Bigelow ..... E04B 1/34321 52/174
6,393,774 B1 * 5/2002 Fisher ..... E04B 1/34823 52/236.3
6,519,900 B1 * 2/2003 Pierce ..... E04B 1/24 52/274
D484,613 S 12/2003 da Costa
6,675,540 B1 * 1/2004 Rokes ..... E04B 1/34336 220/1.5
6,877,939 B2 * 4/2005 Tomkins ..... B65D 88/022 410/34
6,920,721 B2 * 7/2005 Johns ..... B62D 21/20 280/785
6,925,761 B1 * 8/2005 De La Marche ... E04B 1/34815 52/220.1
7,254,923 B2 * 8/2007 Hioki ..... G09F 19/22 52/235
7,584,720 B1 * 9/2009 Jackson ..... A01K 1/033 119/452
D609,363 S 2/2010 Segall
7,765,745 B2 * 8/2010 Kmet ..... E04H 3/02 52/79.9
7,827,738 B2 * 11/2010 Abrams ..... E04B 1/348 52/79.1
8,166,715 B2 * 5/2012 De Azambuja ..... E04B 1/3442 52/79.5
8,176,931 B1 * 5/2012 Cajiga ..... E04H 1/1233 137/234.6
8,186,109 B2 * 5/2012 Warminsky ..... E04H 9/10 52/79.1
8,499,504 B1 * 8/2013 Sherbakov ..... E04B 1/3483 52/79.9
8,622,453 B1 * 1/2014 Karapetian, Jr. ..... B60P 3/0257 296/22
9,556,632 B2 * 1/2017 Malakauskas ..... E04B 1/34838
9,631,359 B2 * 4/2017 Malakauskas ..... E04B 1/34861
9,702,138 B1 * 7/2017 Rutherford ..... E04B 1/34853
D823,480 S 7/2018 Balzer
10,208,475 B2 * 2/2019 Heather ..... B65D 90/0006
10,280,608 B2 * 5/2019 Ledoux ..... E04B 1/3483
10,450,739 B1 * 10/2019 Schlagel ..... E04F 11/02
D911,553 S 2/2021 Konczak
2002/0069566 A1 * 6/2002 Netter ..... G09F 19/22 40/605
2003/0033762 A1 * 2/2003 Sullivan ..... A47F 10/02 52/174
2004/0060588 A1 * 4/2004 Lekhtman ..... A47F 9/00 135/98
2005/0262778 A1 * 12/2005 Allen ..... E04H 1/04 52/79.1
2005/0279032 A1 * 12/2005 Buchanan ..... E04F 10/005 52/36.2
2005/0279035 A1 * 12/2005 Donovan ..... E04B 1/348 52/79.1
2006/0059792 A1 * 3/2006 Tiramani ..... E04H 1/04 52/79.1
2006/0196132 A1 * 9/2006 Ruano ..... E04G 21/142 52/236.3
2006/0230704 A1 * 10/2006 Lambreth ..... E04B 1/34 52/745.02
2007/0039253 A1 * 2/2007 Snowden ..... E04H 1/1222 52/79.1
2007/0163184 A1 * 7/2007 Olesch ..... E04B 1/34869 52/79.5
2007/0187183 A1 * 8/2007 Saigh ..... E04H 14/00 186/53
2007/0193124 A1 * 8/2007 Thompson ..... E04H 12/2276 52/36.1
2007/0256369 A1 * 11/2007 Webb ..... E04B 1/34315 52/79.13
2007/0271857 A1 * 11/2007 Heather ..... B65D 90/006 52/79.9
2008/0221991 A1 * 9/2008 Johnson, Jr. ..... E04H 1/1222 705/14.61
2008/0275778 A1 * 11/2008 Johnson ..... E04H 1/1222 705/14.4
2008/0276553 A1 * 11/2008 Ingjaldsdottir ..... E04F 11/025 52/184
2008/0319853 A1 * 12/2008 Johnson, Jr. ..... E04H 1/1222 705/14.46
2009/0031642 A1 * 2/2009 Donovan ..... F24F 5/0046 52/79.1
2009/0101446 A1 * 4/2009 Franchi ..... E04H 5/06 187/203

(56) References Cited

U.S. PATENT DOCUMENTS

2009/0106102 A1* 4/2009 Johnson, Jr. ..... G09F 19/22 705/14.14
2009/0223144 A1* 9/2009 Leahy ..... E04B 1/34321 52/79.1
2009/0255195 A1* 10/2009 Bridgman ..... E04H 14/00 52/174
2009/0307989 A1* 12/2009 Johnson, Jr. ..... G09F 19/22 52/38
2009/0313185 A1* 12/2009 Johnson, Jr. ..... G06Q 99/00 705/500
2009/0313186 A1* 12/2009 Johnson, Jr. ..... G09F 19/22 705/500
2010/0024353 A1* 2/2010 Pope ..... E04B 1/3431 52/745.02
2010/0183374 A1* 7/2010 Ewers ..... E04H 9/14 405/211
2010/0198667 A1* 8/2010 Johnson, Jr ..... G09F 19/22 705/14.4
2010/0198753 A1* 8/2010 Johnson, Jr. ..... E04H 1/1222 705/500
2010/0320708 A1* 12/2010 Pope ..... B60P 3/34 280/30
2011/0023383 A1* 2/2011 Brouillard ..... B28B 7/0088 52/79.9
2011/0041418 A1* 2/2011 Meserini ..... E04B 1/34869 52/79.9
2011/0056147 A1* 3/2011 Beaudet ..... E04B 1/34869 52/79.9
2011/0162293 A1* 7/2011 Levy ..... E04B 1/3483 52/79.9
2011/0214361 A1* 9/2011 Ingjaldsdottir ..... E04H 1/00 52/79.1
2012/0023837 A1* 2/2012 Eisenbeisz ..... E04H 1/02 52/79.5
2012/0031014 A1* 2/2012 Davis ..... E04B 1/34838 52/79.6
2013/0067832 A1* 3/2013 Collins ..... E04B 1/343 52/125.1
2013/0118094 A1* 5/2013 Laspia ..... G06Q 30/06 52/79.1
2013/0180182 A1* 7/2013 Yoo ..... E04H 1/1272 52/6
2013/0239487 A1* 9/2013 Ingjaldsdottir ..... E04B 1/3483 52/79.1
2013/0305629 A1* 11/2013 Stephenson ..... E04B 1/3483 52/79.9
2013/0326968 A1* 12/2013 Meyer ..... E04C 3/36 52/126.7
2014/0116870 A1* 5/2014 Kamen ..... F01K 17/04 202/83
2014/0183330 A1* 7/2014 Simmons ..... E04G 17/14 249/49
2014/0298745 A1* 10/2014 Rechenmacher ..... E04B 1/165 52/425
2015/0075271 A1* 3/2015 Tracy ..... G01M 17/02 73/146
2015/0113885 A1* 4/2015 Le Carpentier ..... E04G 9/06 52/79.1
2015/0152634 A1* 6/2015 Unger ..... E04H 3/02 52/79.2
2015/0266616 A1* 9/2015 Barrable ..... B65D 90/0006 206/512
2016/0168844 A1* 6/2016 Lago De Carvalho ..... E04B 1/34315 52/79.5
2016/0237676 A1* 8/2016 Devlin ..... E04B 7/026
2017/0024834 A1* 1/2017 Peterson ..... G06Q 20/203
2017/0066590 A1* 3/2017 Albanese ..... B65D 90/0006
2017/0198489 A1 7/2017 Klein
2018/0109163 A1* 4/2018 Paine ..... H02K 7/1815
2018/0347175 A1* 12/2018 Anderson ..... F04D 29/601

OTHER PUBLICATIONS

Inhabitat "Starbucks Opens New Reclamation Drive Thru Made From Recycled Shipping Containers"; https://inhabitat.com/starbucks-opens-new-reclamation-drive-thru-made-from-recycled-shipping-containers/; published Jan. 8, 2012; accessed Dec. 3, 2021 (Year: 2012).*

Nate Eaton, Dutch Bros opens in Idaho Falls Wednesday with free drinks, May 1, 2018, https://www.eastidahonews.com/2018/05/dutch-bros-opens-in-idaho-falls-wednesday-with-free-drinks-for-customers/ (Year:2018).

GSR Drive Thru & Dine-In Restaurant, Jan. 17, 2017, https://americanmodulartechnologies.com/restaurants.htm (Year:2017).

Starbucks, Starbucks Opening Innovative New Drive Thru Stores in Markets Around the U.S, Sep. 23, 2013, Starbucks Stories & News, https://stories.starbucks.com/stories/2013/innovative-new-drive-thrus/ (Year: 2013).

* cited by examiner

MODULAR MINI BUILDING SYSTEM FOR PARKING LOTS

RELATED APPLICATIONS/PRIORITY BENEFIT CLAIM

This application claims the benefit of U.S. Provisional Application No. 62/714,824 filed Aug. 6, 2018 by the same inventors (Konczak and Stevens), the entirety of which provisional application is hereby incorporated by reference. This application is also related to the U.S. design patent application Ser. No. 29/659,039 entitled "MODULAR DRIVE-THRU BUILDING" filed Aug. 6, 2018, also by the same inventors (Konczak and Stevens).

FIELD

The subject matter of the present application is in the field of small modular buildings used for selling retail goods and services.

BACKGROUND

Small modular buildings for retail food, drive-thru, auto service, and other businesses are known. Examples include those shown in U.S. Pat. No. 5,109,956 to Casale et al. (easily installed food service facility modules for shopping center parking lots); U.S. Pat. No. 5,613,331 to LaGanke (modular oil change and lubrication center for mall parking lots); U.S. Pat. No. 8,622,453 to Karapetian, Jr. (mobile food service unit with drive-thru capability); U.S. Published Application No. 2009/0255195A1 to Bridgman et al. (drive-thru system and method for building in a parking lot); and U.S. Published Application No. 2015/0075271A1 to Tracy et al. (modular, portable, drive-thru tire tread wear and brake testing system for temporary set-up in existing parking lots).

Installing such small retail goods-and-services buildings in existing parking lots, such as those associated with malls and large department stores, places a high premium on efficiency with respect to delivery, assembly or installation, and use. Failure to achieve any of these with respect to a particular building installation can make it impractical.

Another common problem is the regulation and cost associated with putting additional signage in an existing store parking lot. Pylon-type signage limits are often restrictive, and the existing store or mall may not be able to accommodate adequate signage for a complementary business operating out of a modular building installed in the parking lot.

BRIEF SUMMARY

The present invention is a modular building system, particularly suited for installation of a small modular building in an existing parking lot, for example to house a small retail business complementary to an existing store's business in the store's parking lot. Suitable small retail businesses include, but are not limited to, drive-thru coffee and specialty food establishments smaller than typical full-menu, full-service fast food restaurants.

In a first form, the present system comprises three modular building sections sized to make substantially full use of a standard (non-"wide load") trailer or tractor-trailer bed for delivery, for example on the order of 9' (feet) wide by 27'(feet) long. A first building section comprises a main rectangular one-story service area approximating a first trailer bed and configured to be delivered on a first trailer.

Second and third building sections comprise dimensionally similar, smaller "cube" sections. The second and third cube sections are configured to be delivered on a second trailer, and to be assembled by stacking them on top of one another to form a multi-story utility tower connected to the main rectangular section when installed in a parking lot.

In a further form, a fourth modular section comprises a carport sized and configured to fit the remaining third of the trailer occupied by the tower cube modules, in complementary relationship to the other modules.

While two tower cubes plus a carport is a preferred combination to substantially fill the space on a trailer bed, it would also be possible to size two tower cubes to substantially fill the trailer bed. If the tower cubes fill the trailer bed, then the carport section may be sized to fit or nest over one of the modular tower cubes (or over the main rectangular building section) in order to stay within the dimensions of the trailer bed.

The modular building sections are fully pre-built prior to being loaded onto the trailers and delivered to the parking lot. By "pre-built" is meant substantially finished and ready for use (kitchen or other retail business appliances, electrical wiring, plumbing, heating and cooling systems, bathrooms, seating, etc.) modules, ready to be connected into a single building and to be hooked up to pre-installed utilites in the parking lot.

The upper tower cube comprises large, flat, elevated side walls suitable for functioning as billboards for business signage at a height above the roof of the main ground level building module. These elevated signage walls comply with sign ordinances due to their height and due to their being an integral part of the building.

In a further aspect of the invention, the modules are anchored to the parking lot using a tie-down system secured in concrete tube forms placed in holes drilled in the parking lot.

In a further aspect of the invention, utilities are provided to the modular building site in the parking lot with directional bore utilities, for minimal disruption to the parking lot surface and subsurface. A "force main" or pressurized type sewer is preferred for similarly minimal disruption to the parking lot.

Particular dimensions and geometry descriptions such as "cube" and "rectangle" are used herein to mean generally or more or less so, and encompass within their scope manufacturing variances, customized or business-specific functional features, variations in trailer widths and lengths, and other factors that will be apparent to those skilled in the art.

These and other features and advantages of the invention will become apparent from the detailed description below, in light of the accompanying drawings.

DETAILED DESCRIPTION

Figure 1:
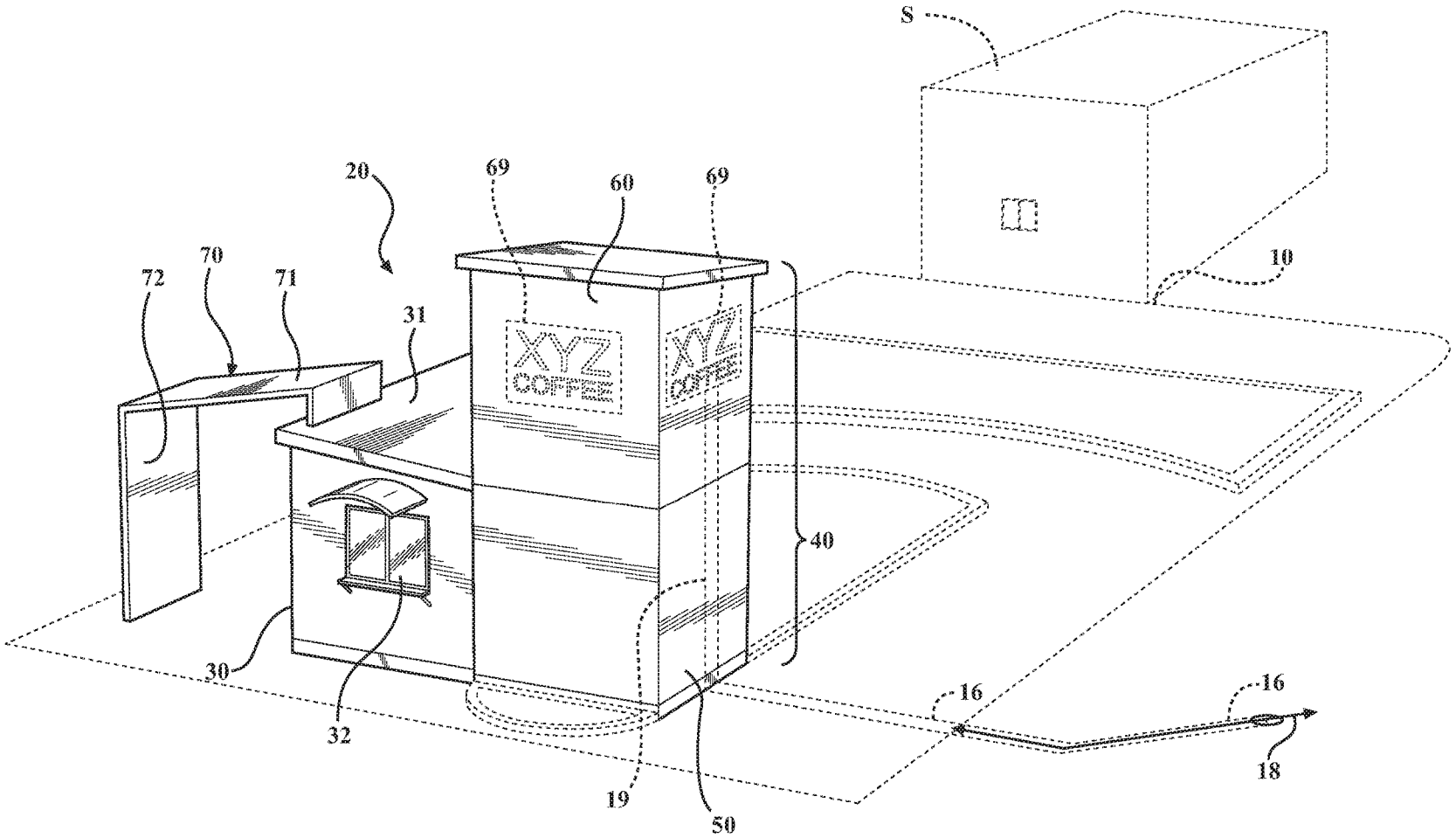
FIG. 1 is a first end perspective view of an exemplary modular building according to the present invention, installed in a parking lot, taken from an elevated vantage point.

Referring first to FIG. 1, a small modular building 20 is shown installed in a parking lot 10 in order to teach how to make and use the claimed invention. Parking lot 10 in the illustrated example is associated with an existing building or collection of buildings S such as a superstore, shopping center, or retail mall (hereafter "store"). Parking lot 10 need not be associated with a functioning, existing store, however; the parking lot could be an abandoned or empty lot, or a lot associated with a closed or abandoned store.

Modular building 20 is configured for retail sale of goods and/or services, ideally complementary to the business of any existing store S, for example a drive-thru for coffee, donuts, etc. Modular building 20 may also include walk-in or sit-down service for a small number of customers, with limited seating and an ADA-approved restroom. Another possible example of a complementary small business suitable to be conducted from modular building 20 is a pharmacy or other typical in-store department of existing main store S, such that modular building 20 functions as a physically separate department of the main store, with corresponding signage, that can be accessed directly from the parking lot.

Modular building 20 includes a one-story or ground-level main rectangular service module 30, a two-story tower 40 connected to main service module 30 to form a contiguous single building with a common interior, and a drive-thru carport 70.

Main service module 30 houses the equipment and work staff needed to provide the goods or services (e.g., coffee) for drive-thru customers, and optionally includes seating for customers if sit-down service is offered. Equipment will depend on the type of business, but things such as stoves and ovens, refrigerators and freezers, counters, sinks, dishwashers, computers, cash registers/terminals, coffee-brewing machines, drive-thru order taking systems, lighting, and display boards and cabinets would be typical for a food-related business.

Tower 40 includes upper and lower modular cube sections 50, 60 each of which comprise a room. Upper section 60 is the "mechanical" room, housing the primary in-house electrical and plumbing apparatus such as HVAC equipment, junction boxes and breaker panels, and water tanks and treatment. Lower section 50 is a restroom, meeting ADA standards, with a door 33' connecting it with the interior of main service module 30 for the use of workers and customers. Lower section 50 may also include a janitorial storage area for cleaning supplies.

Utilities 18 such as water, electrical power, gas, sewer, and/or communications are provided to the modular building 20 via one or more directional bores schematically shown at 16 in FIG. 1. Directional bore 16 preferably opens in an unpaved area outside the parking lot 10 in known manner, and is drilled laterally underneath the parking lot surface to a location under the modular building's installation site using known techniques. The in-house utility systems in the modular building may be connected to the water, power, gas, and communication-using apparatus in building 20 with known types of connections located in the base of the lower tower module 50 and extending or branching to the upper tower module 60, the connections schematically shown at 19 in FIG. 1.

Figure 9:
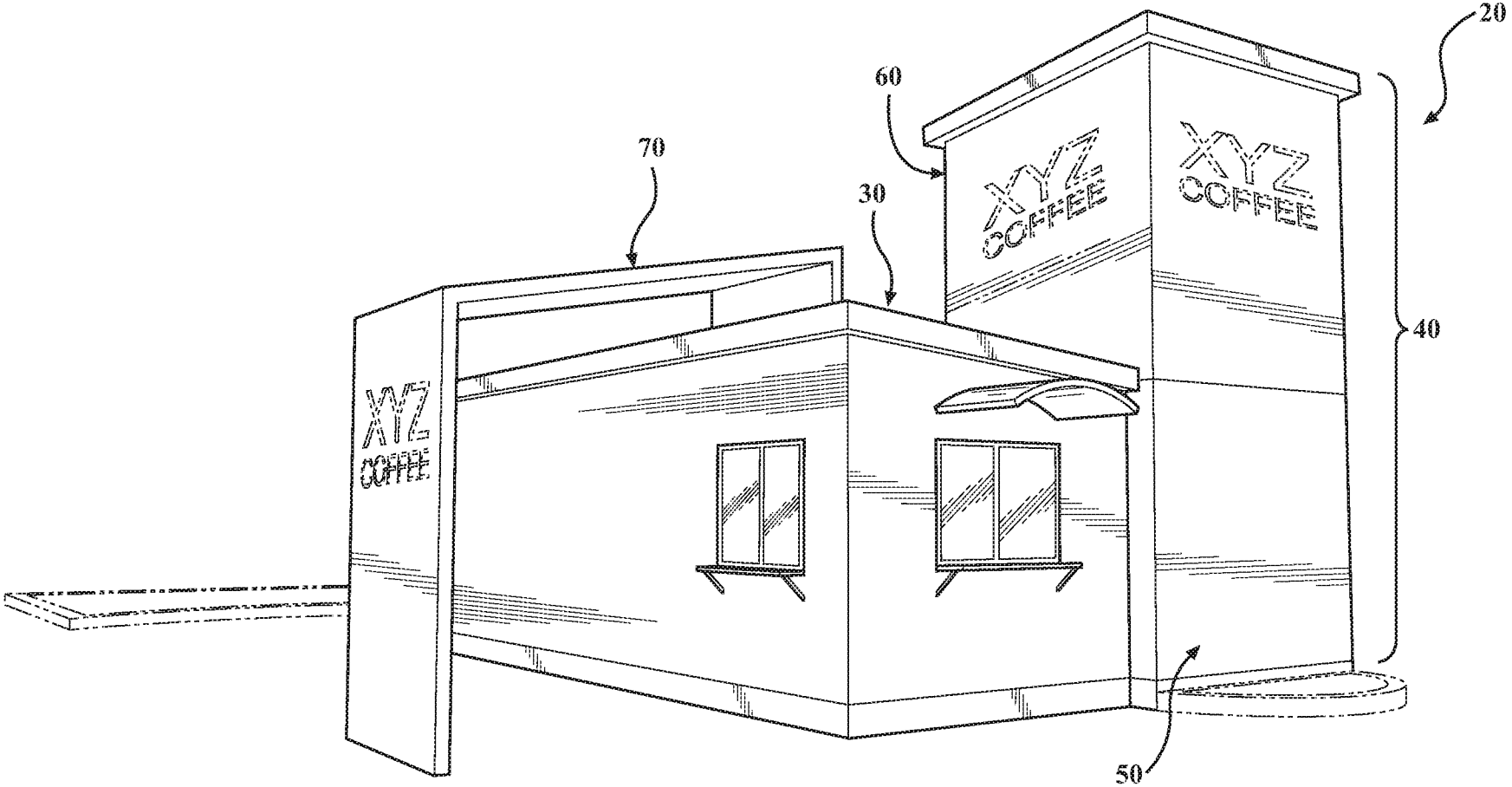
FIG. 9 is a first end perspective view of the building of FIG. 1, from an opposing angle.
Figure 10:
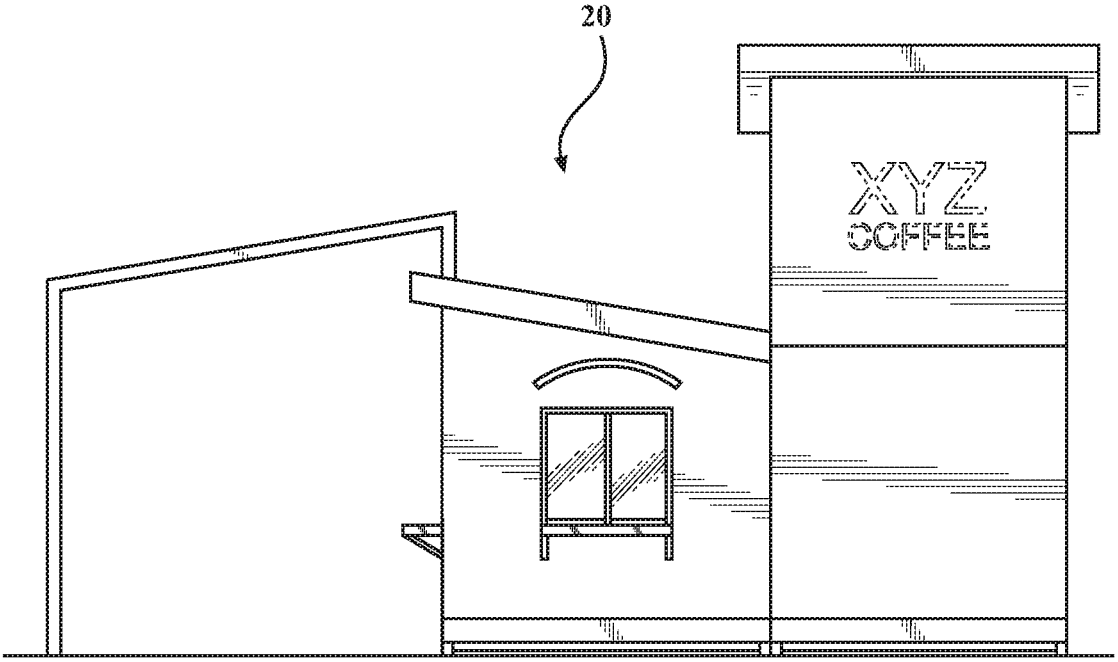
FIG. 10 is a first end elevation view of the building of FIG. 1.
Figure 11:
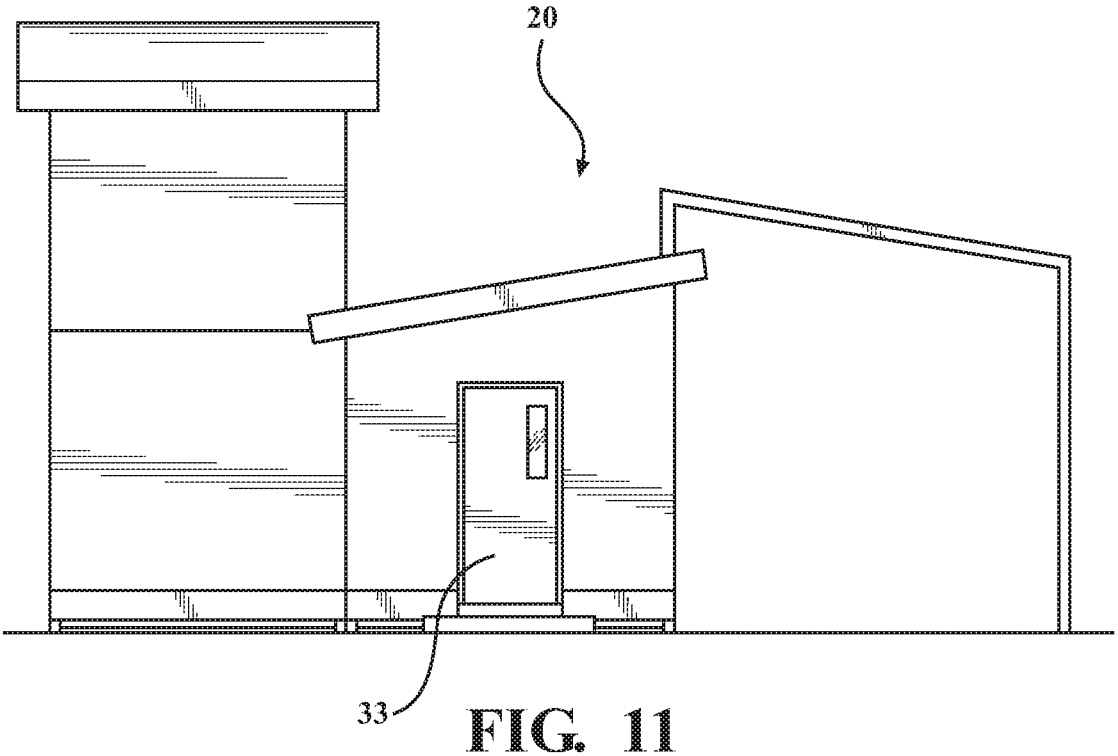
FIG. 11 is a second end elevation view of the building of FIG. 1.
Figure 12:
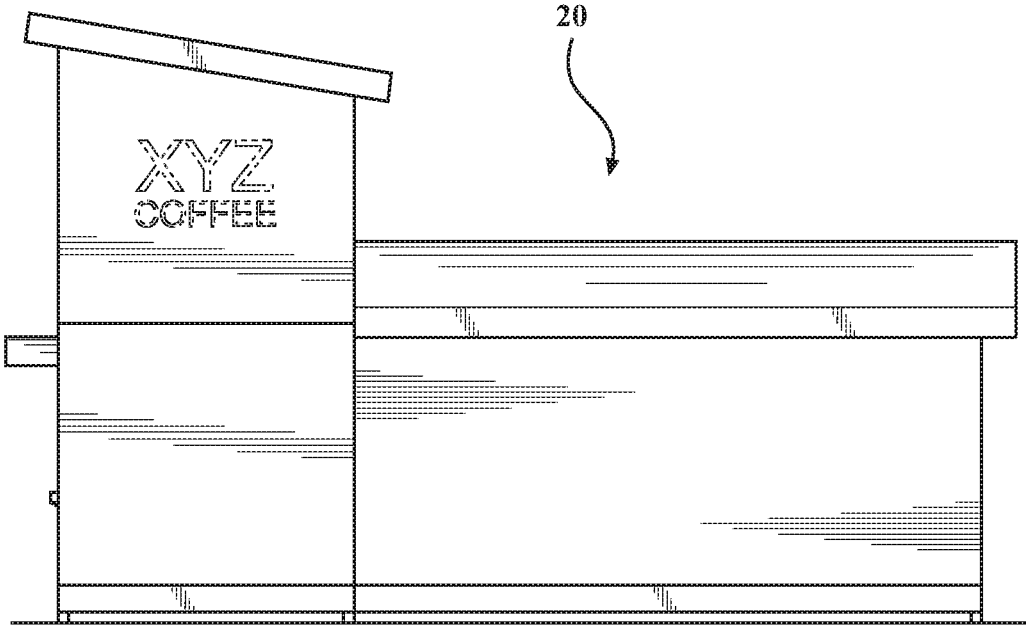
FIG. 12 is a rear side elevation view of the building of FIG. 1.
Figure 13:
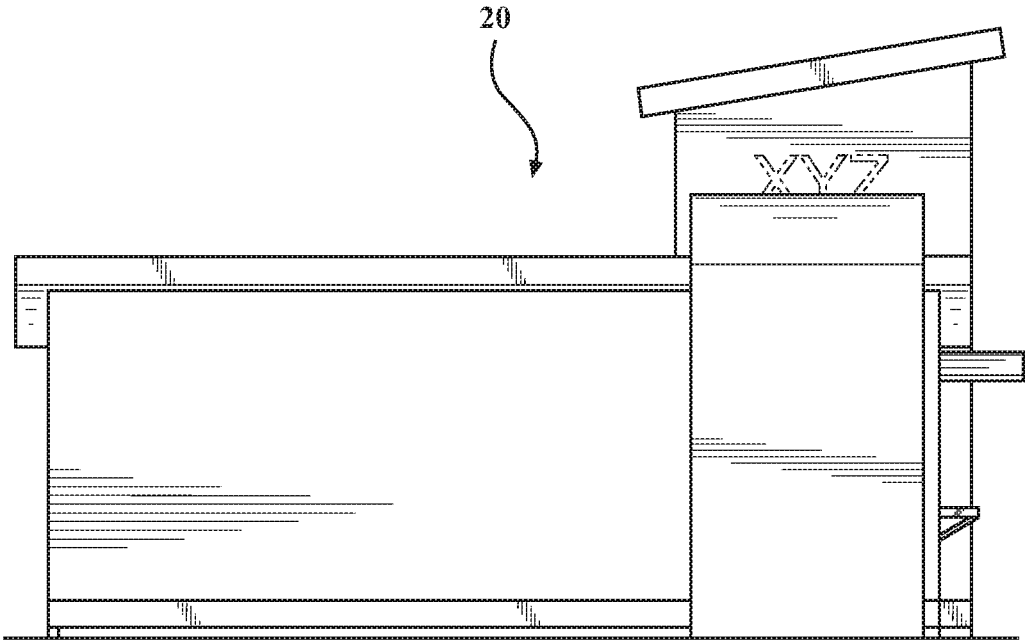
FIG. 13 is a front side elevation view of the building of FIG. 1.
Figure 14:
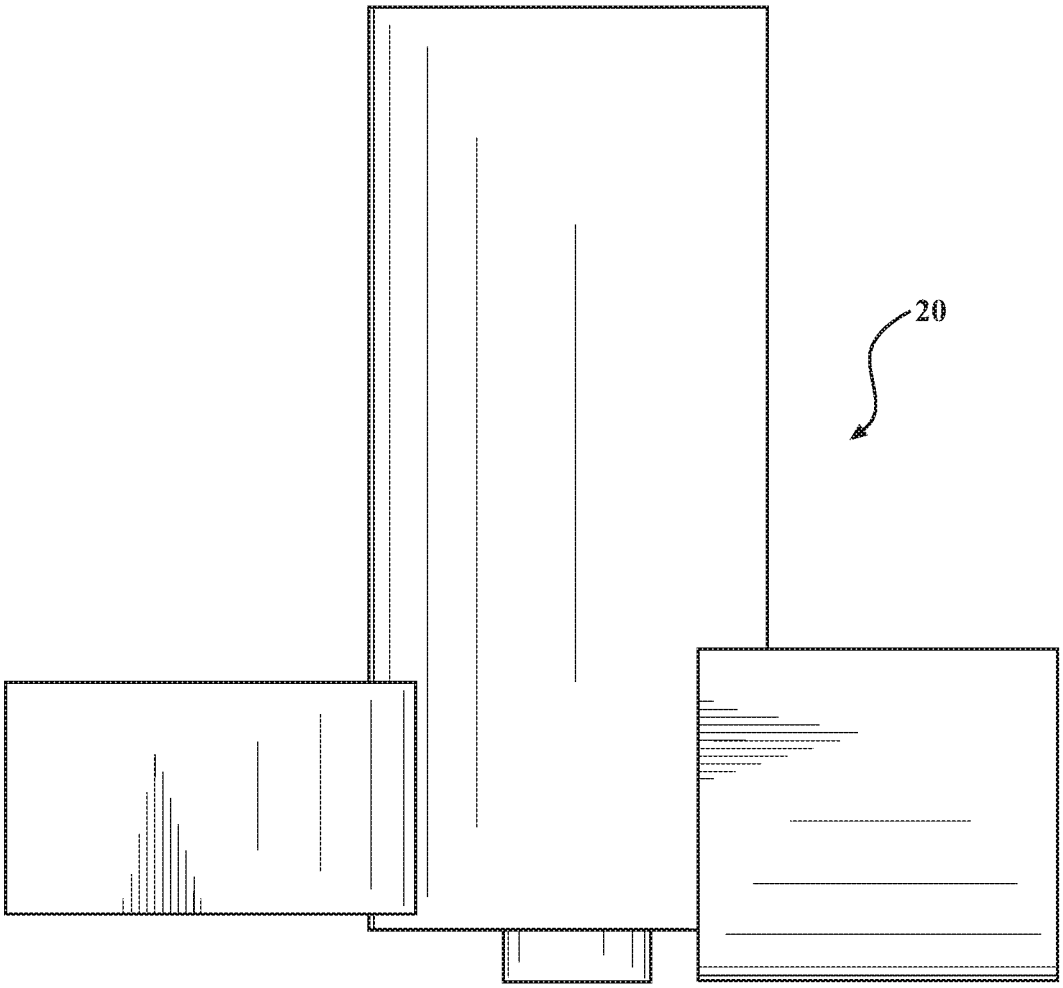
FIG. 14 is a top plan view of the building of FIG. 1.

Modular building 20 includes a rigid drive-thru carport 70 comprising a sidewall 72 and a roof 71 connected to the main service module 30, for example at the roof 31. Drive-thru service features such as cashier and food delivery windows 32 are provided in the main service module 30, at least one of which (FIGS. 4, 5, and 9) is associated with the area covered by carport 70. A door 33 (FIGS. 4, 5, and 11) is provided in at least one of the walls of service module 30 for entry and exit by workers and customers.

Figure 2:
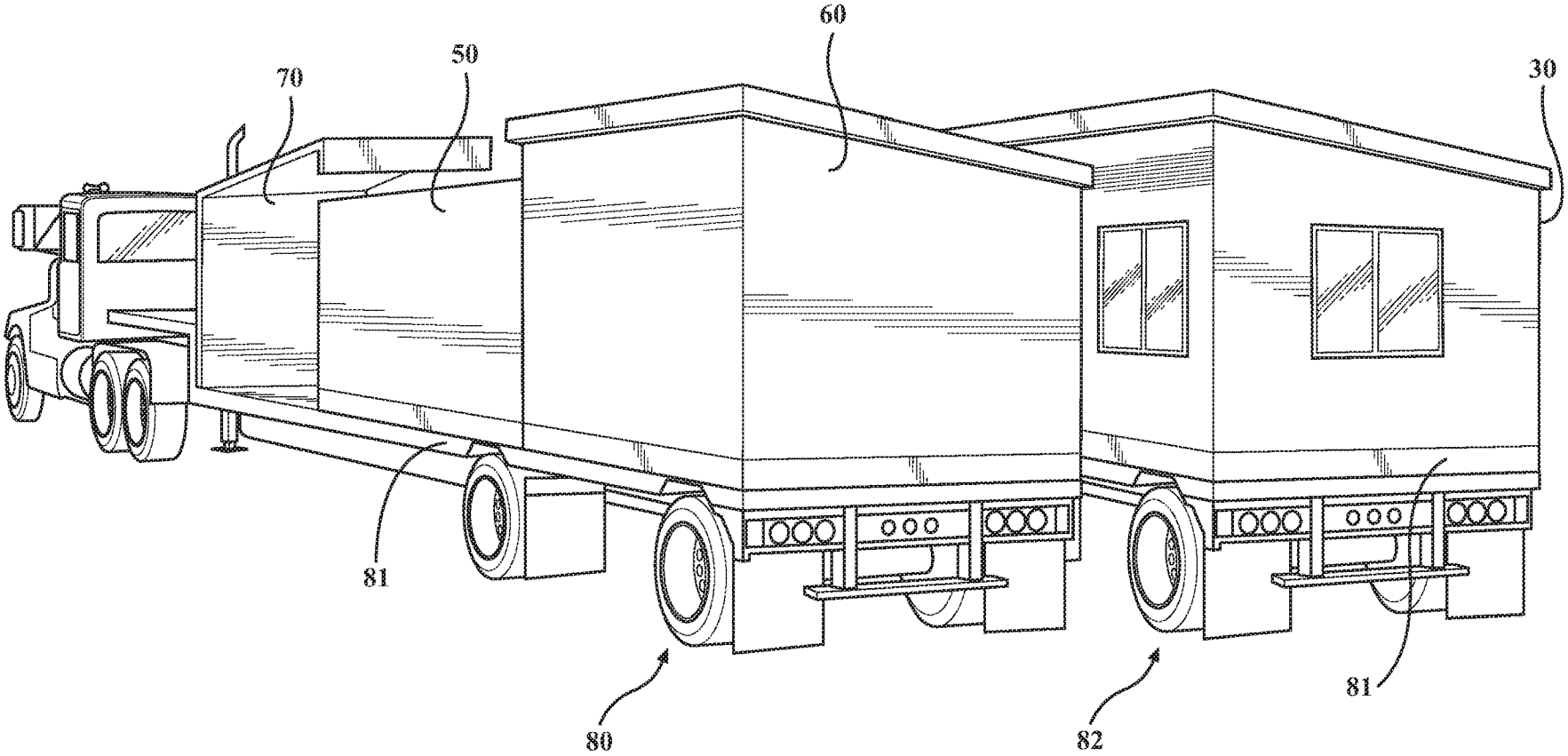
FIG. 2 is a perspective view of the pre-built, disassembled module sections of the building of FIG. 1, placed on two tractor-trailers for delivery to the parking lot installation site.

FIG. 2 shows the constituent modules 30, 50, and 60 that form the modular building 20, loaded onto two tractor-trailers 80, 82 of known type for delivery to the parking lot. Main service module 30 is sized to fit on and make substantially full use of one tractor-trailer bed 81 for delivery to the parking lot installation site in a single story configuration. Tower cube modules 50 and 60 and carport 70 are sized to fit on and substantially fill another substantially identical tractor-trailer bed 81 for delivery to the parking lot installation site in a single story disassembled configuration. In the illustrated example, main service module is approximately 9' (feet) wide by 27' (feet) long, making full use of a 9'×27' standard tractor-trailer bed. Illustrated tower cube modules 50 and 60 are dimensionally similar with 9'×9' footprints and similar (although not necessarily identical) wall heights. Carport 70 may have a sidewall height approximating the height and/or width dimensions of the tower cube and main service modules as illustrated in FIG. 2, for example 9' (feet), in order to fit neatly into the remaining space on the second tractor-trailer bed 81 with the tower cube modules. The length of the carport roof portion may be longer, and the carport can be positioned so that at least some of the roof overlaps an adjacent module on the trailer.

Likewise, if a third tower cube (not shown, but substantially the same as either one of modules 50, 60) is desired for a taller assembled tower, or if modules 50 and 60 are sized differently to take up the entirety of the trailer bed on their own, the example illustrated carport sidewall and roof dimensions can be sized to fit or nest against one of the sidewalls and over an upper edge or roof portion of the adjacent tower cube module for delivery on the same trailer.

Figure 3:
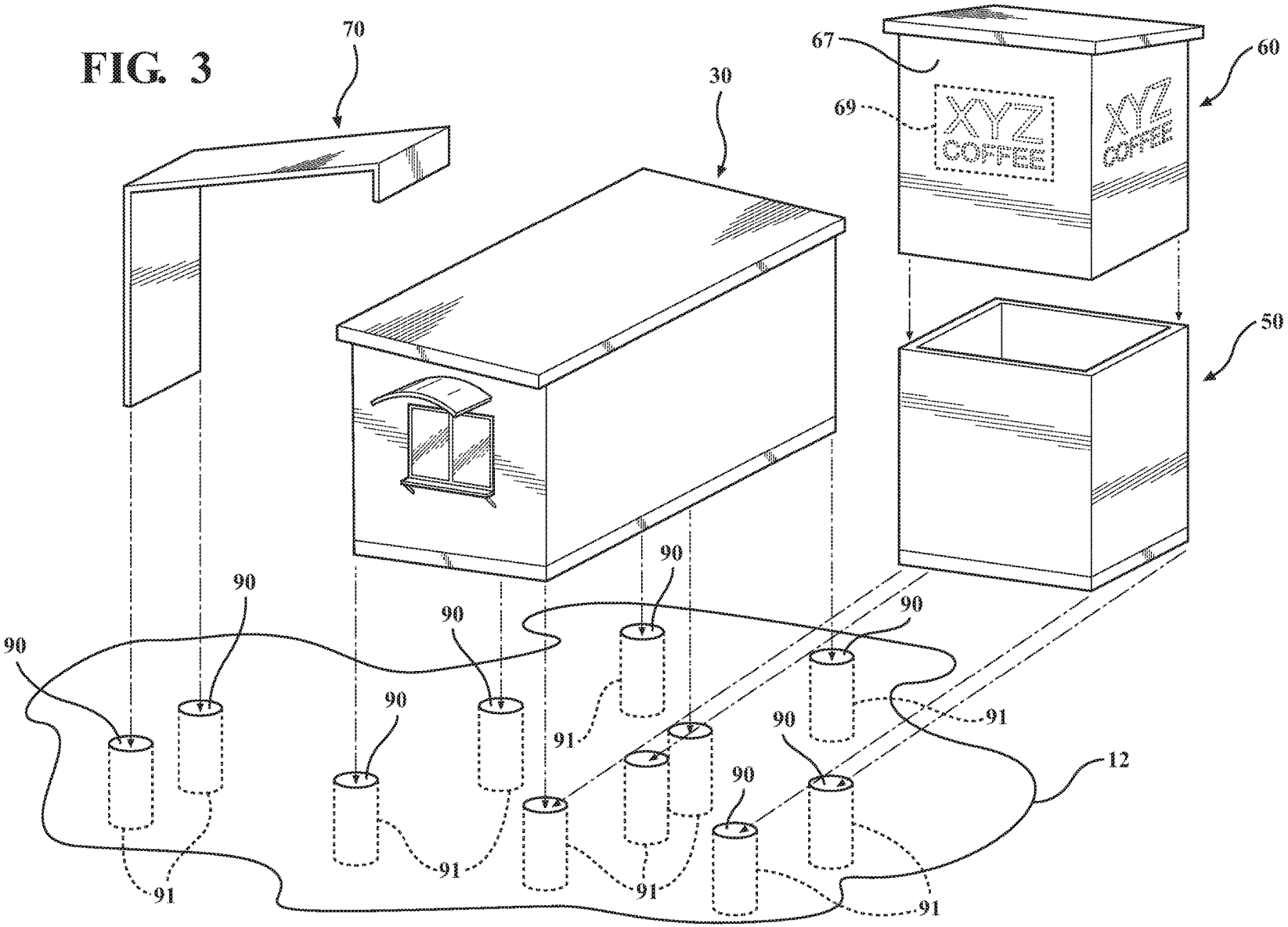
FIG. 3 is an assembly view of the module sections of the building of FIG. 1, exploded relative to their installation positions on concrete tube forms pre-installed in the parking lot.

FIG. 3 shows the constituent modules of building 20 in an exploded assembly relationship relative to the designated installation site 12 on parking lot 10. Installation site 12 is provided with anchor points 90 prior to delivery and assembly of the modules. In the illustrated example, anchor points 90 are commercially available concrete tube forms placed in bores 91 drilled into the pre-existing parking lot surface and subsurface, in a pattern corresponding to the lower frame outlines of the first-story building modules in their joined-together configuration. Modules 30, 50, 60, and 70 are pre-built and can simply be lowered or skidded into position to be joined together over the bores 91 and their empty concrete tube forms 90, with anchors or ties extending from the lower module frames into the tubes to be secured with a subsequent filling of concrete or equivalent anchoring material poured into the tubes.

Figure 4:
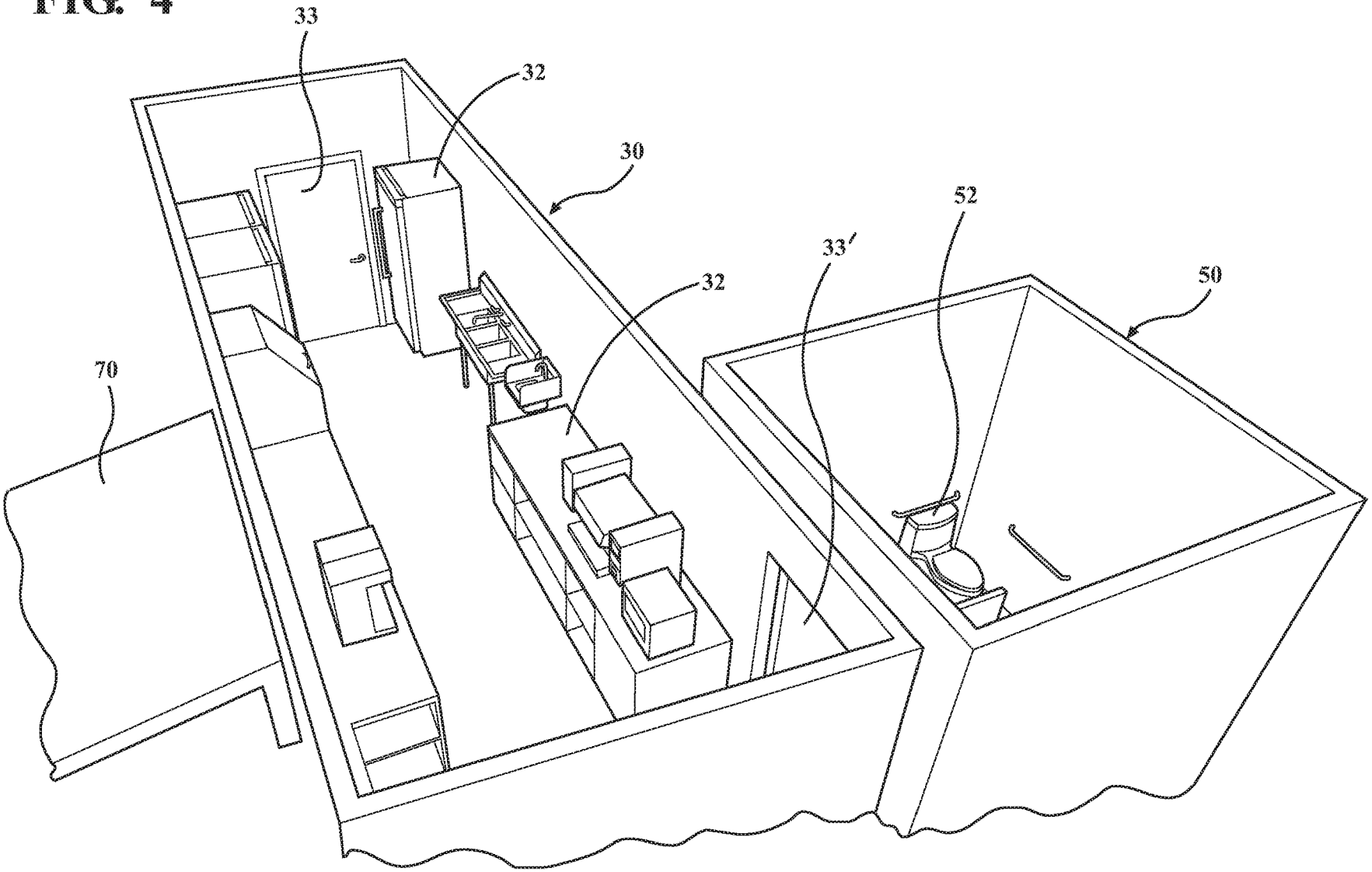
FIG. 4 is a perspective schematic view of example interiors of the main rectangular building module and the lower story tower cube.
Figure 5:
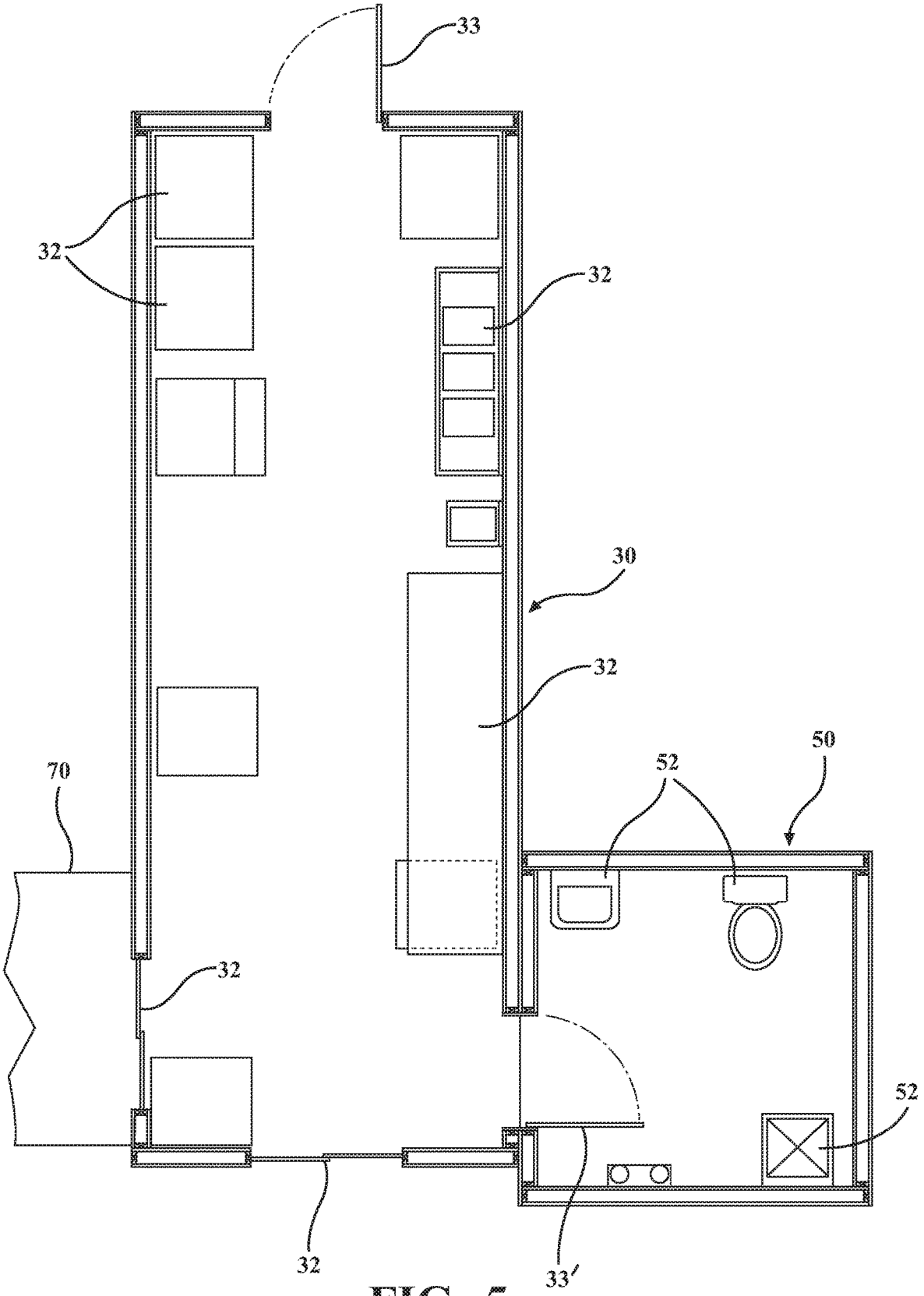
FIG. 5 is a top plan schematic view of the interiors of FIG. 4.

FIGS. 4 and 5 are schematic representations of example interiors of the main service module 30 and the lower tower cube module 50. The relevant interior features and equipment 32, 52 that make the joined modules functional as a retail business are pre-installed in their respective modules prior to delivery to installation site 12. The same is true of the mechanical and utility-room features of the upper tower cube module 60. The modules 30, 50, and 60 are accordingly pre-built prior to delivery to the installation site on a parking lot, so that connecting them to one another and to the on-site utility supply lines (water, sewer, electric, communication) makes the modular building 20 functional. It should be understood that minor finishing and customizing touches may be reserved, if desired, for installation or application after the basic pre-built functional modules are delivered and assembled on-site, such as painting, trim, floor finishes, etc.

Figure 6:
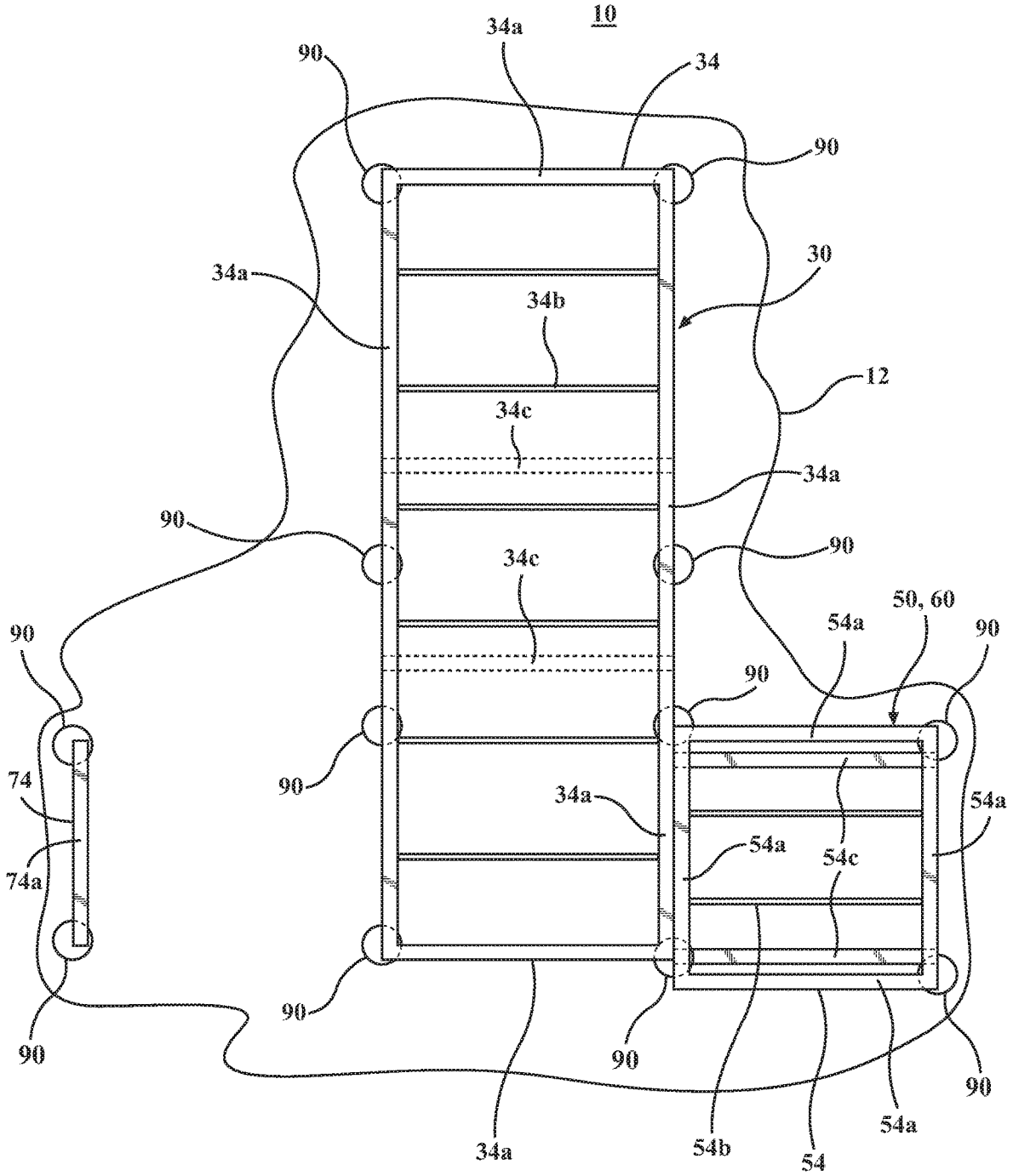
FIG. 6 is a top plan view of the frame structure of the building of FIG. 1, in particular the lower frame and foundation members in contact with, and anchored to, the parking lot.
Figure 7:
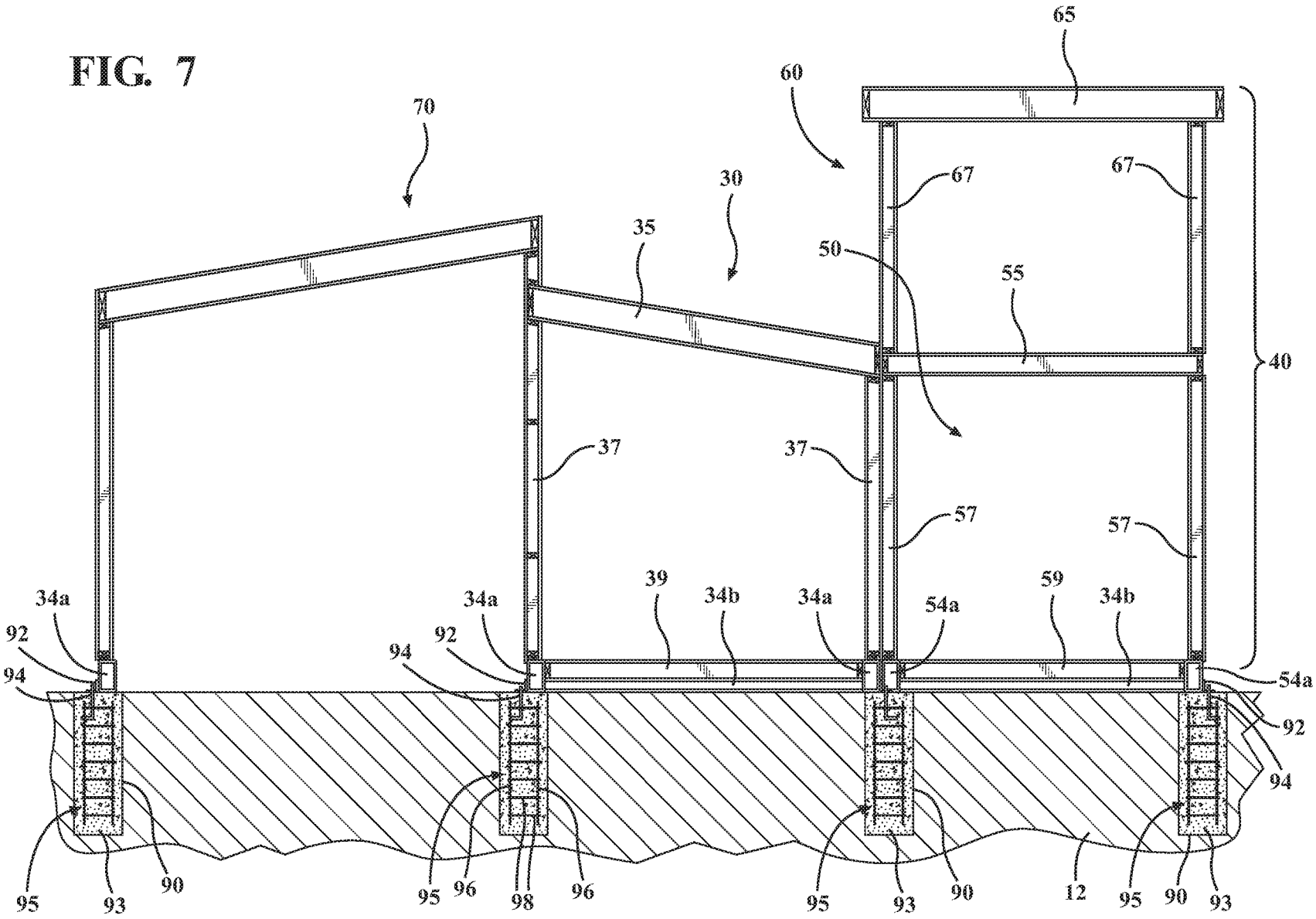
FIG. 7 is a first end elevation view of the frame structure of the building of FIG. 1, and a section view of the concrete tube forms in the parking lot with anchor tie-downs embedded therein.
Figure 8:
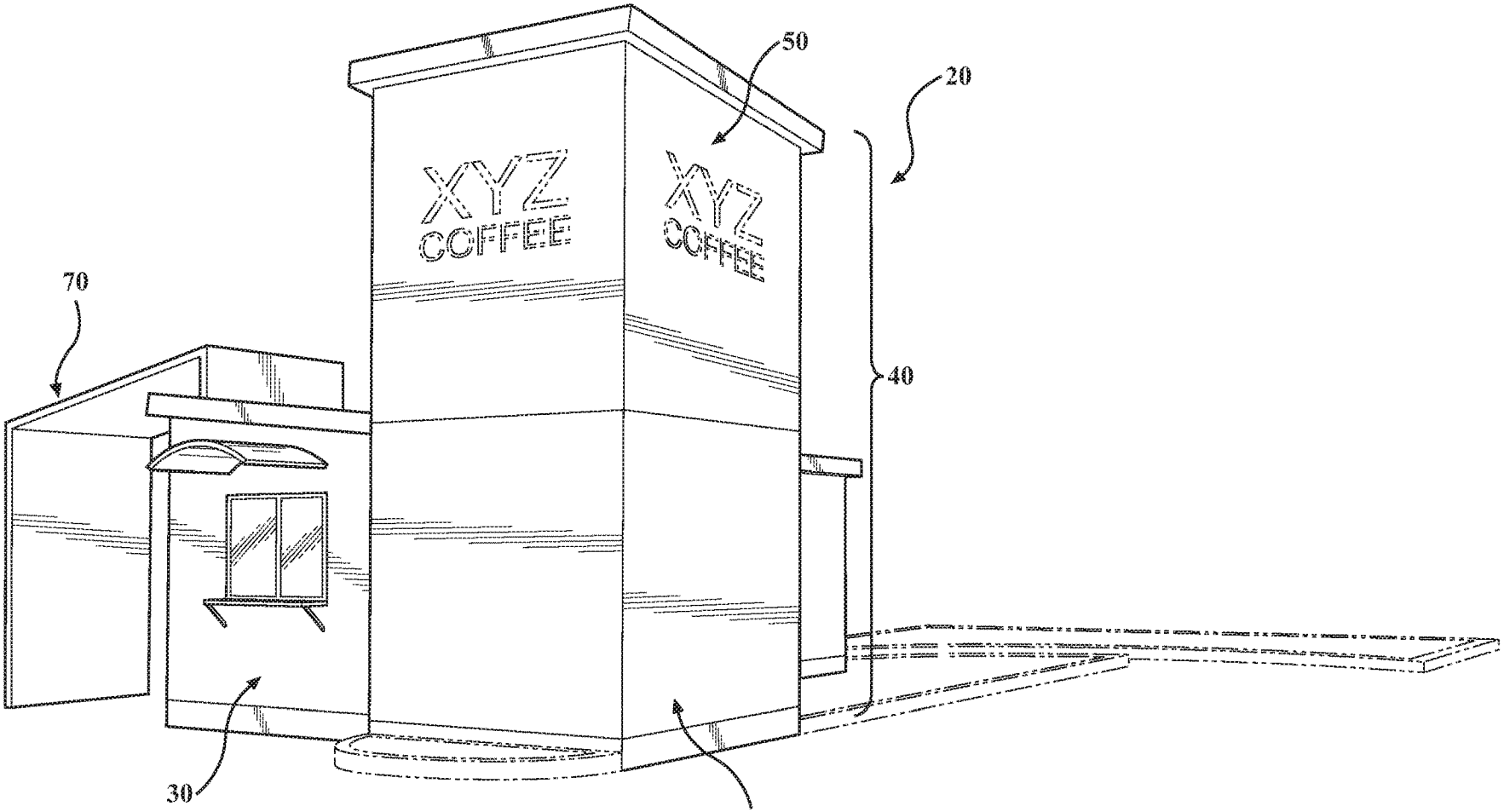
FIG. 8 is a first end perspective view of the building of FIG. 1, similar to FIG. 1 but from a parking-lot level vantage point.

FIGS. 6 and 7 show the preferred frame-and-panel construction of the modules 30, 50 and 60. In FIG. 6, the lower edges 34, 54, 74 of the respective ground-level modules (main, restroom, and carport) are formed by rectangular steel tubing to form a steel skid foundation. The concrete tube forms 90 are installed to be aligned with the outermost lower frame members 34*a*, 54*a*, 74*a* in a desired anchor pattern. Cross-members 34*b*, 54*b* serve as internal frame bracing and/or floor panel supports. The steel frame members may be joined using known types of mechanical fasteners or welding techniques. FIG. 6 also shows forklift channels 34*c* and 54*c* associated with the lower frame members of each module, useful for moving the modules on and off delivery trucks and for positioning or lifting the modules at the building site. The steel frame members may be supplemented in known manner, for example with treated lumber overlaid on the frame to help bear the weight of wall panels.

FIG. 7 additionally shows structural insulated panels of known type used for the walls and roof portions of the various modules, joined directly together in known fashion. Main service module 30 has roof panels 35, wall panels 37, and floor panels 39. Lower tower cube module 50 has ceiling, wall, and floor panels 55, 57, and 59. Upper tower cube module has roof and wall panels 65, 67, with the ceiling panel 55 of the lower tower cube module functioning as the floor of the upper room. While the example frame and panel construction is preferred for the modules, other known types of construction and/or materials may be suitable and used depending on factors such as preference, climate, and local building codes. The exterior surfaces of the modules may be faced with various materials suitable for the local aesthetic preferences or requirements, weather conditions, or other factors.

The lower steel frame/foundation members 34*a*, 54*a*, 74*a* of the modular building 20 are secured in the pre-installed concrete tube forms 90 via angle iron members 92 connected at one end to the steel frame/foundation members and at their other end to hook anchors 94. The lower ends of hook anchors 94 extend down into the interiors of concrete tube forms 90, where they are connected to reinforced steel anchor structures 95 located in the concrete tube forms. In the illustrated example, anchor structures 95 are formed from a vertical rectangular array of spaced rebar 96 connected with a spaced array of horizontal steel hoops 98 to form a lattice-like column. Once the anchors 94 and anchor structures 95 are positioned in concrete tube forms 90, concrete 93 can be poured into the tube forms, flowing around the anchors to harden and secure the modular building in place.

It will be understood that other known anchoring structures and techniques suitable may be suitable for securing modular building 20 to an existing parking lot, but the structure and method disclosed above is preferred and believed to be superior to other tie-down type foundations. The manner of assembling or connecting the pre-finished modules 30, 40, 50, and 70 to one another will be apparent to those skilled in the art, and may comprise any known technique or combination of techniques, such as but not limited to the use of self-tapping metal screws, coarse-threaded bolts through pre-formed bores in frame members, nailing, structural adhesives, and combinations thereof.

FIGS. 1-7 also generally show the upper walls 67 of tower portion 40, i.e. the sidewalls of the upper tower cube module 60, being used as the "billboard" or sign for the retail business operated out of modular building 20. The height of the walls of the upper cube module 60 provide suitable square footage and a height above the roof portion of main service module 30 to allow the name of the business to be clearly displayed on a designated signage portion 69, optionally on all sides to potential customers in the parking lot. This sign-supporting capability of the upper walls of the tower portion of the modular building eliminates the need for costly (and sometimes restricted) pylon signage, because the sign surfaces are part of the building itself.

FIGS. 8-14 illustrate the external appearance of the example assembled building of FIGS. 1-7 from different perspectives. The proportions and relative dimensions of the illustrated modules, their roof configurations, door and window configurations, the location and shape of the carport, and the relative positions of the modules to one another when assembled into a building may vary from those shown according to aesthetic preference, available delivery trailer dimensions for the various modules, number of modules assembled, and other factors that will now be apparent to those skilled in the art. Exterior surface finishes may of course vary depending on aesthetic preference and the illustrated modules are not limited to any particular surface finish or material.

Figure 15:
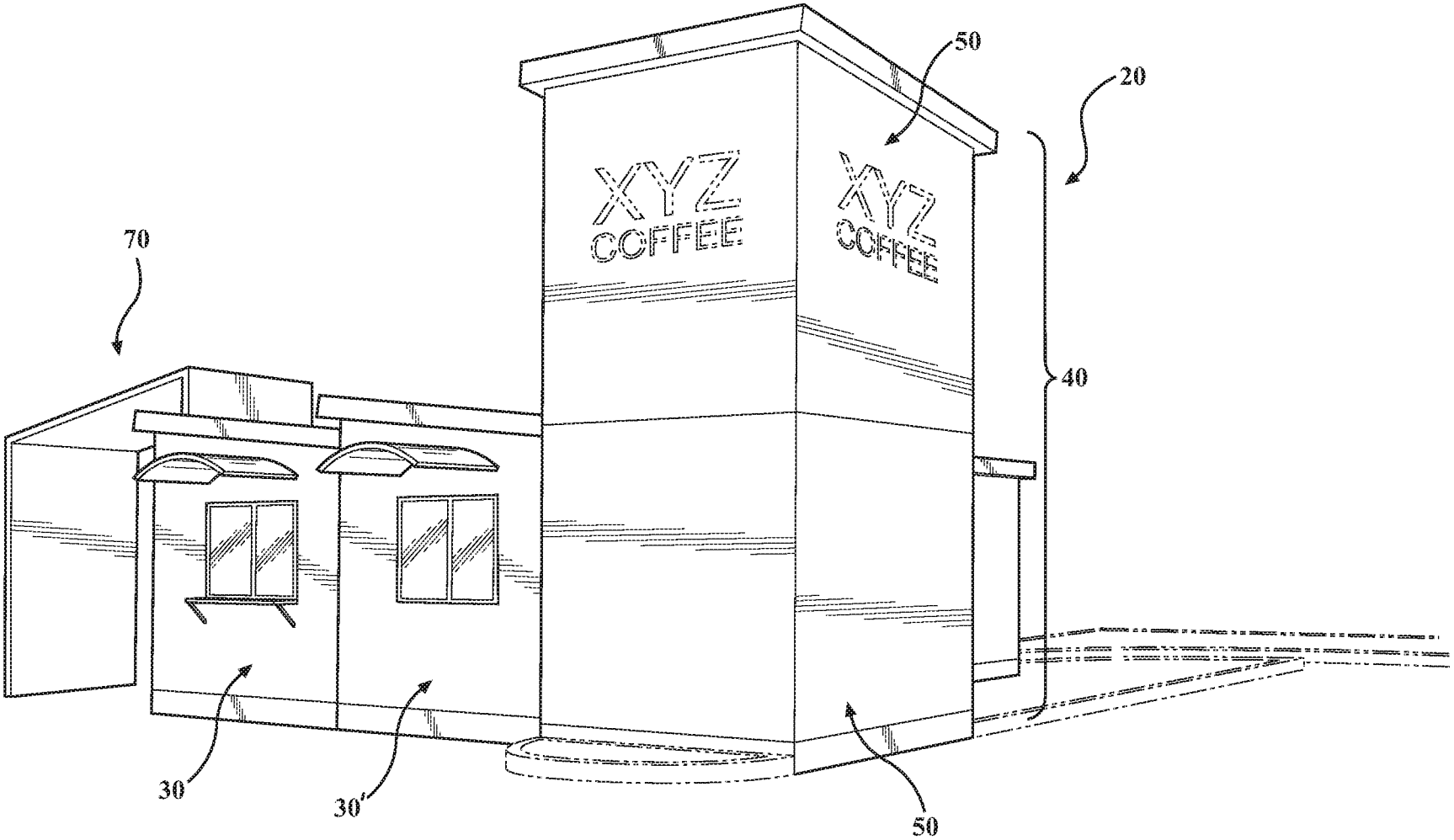
FIG. 15 is an end perspective view, similar to that in FIG. 8, showing the building modified with an additional ground level seating module.

The modular nature of the main service module 30 and the tower cube modules 40, 50, their simple manner of assembly to one another and placement and anchoring on a parking lot building site, and the centralized utility function of the upper tower module allow different combinations of modules to be assembled as needed or desired with differing relative positioning to one another. For example, as shown in FIG. 15, an extra ground-level service module 30' can be added between the main service module 30 and the tower modules 40, 50 so that the outer service module 30 can be dedicated for customer seating, while the inner service module 30' functions as the main kitchen and service area, with pass-through interior doors between the main service modules 30, 30' and the lower bathroom module 40 on the assembled tower. Another example would be positioning the tower assembly 40, 50 along a middle portion of the sidewall of main service module 30 rather than at one end of the main service module sidewall.

It will finally be understood that the disclosed embodiments represent presently preferred examples of how to make and use the invention, but are intended to enable rather than limit the invention. Variations and modifications of the illustrated examples in the foregoing written specification and drawings may be possible without departing from the scope of the invention. It should further be understood that to the extent the term "invention" is used in the written specification, it is not to be construed as a limiting term as to number of claimed or disclosed inventions or discoveries or the scope of any such invention or discovery, but as a term which has long been used to describe new and useful improvements in science and the useful arts. The scope of the invention supported by the above disclosure should accordingly be construed within the scope of what it teaches and suggests to those skilled in the art, and within the scope of any claims that the above disclosure supports in this application or in any other application claiming priority to this application.

The invention claimed is:

1. A method of providing a modular building for conducting a retail business in a parking lot, comprising:

pre-fabricating offsite a first main service section comprising a rectangular one-story service area module having a first width and a first length that is greater than the first width;

pre-fabricating offsite second and third tower sections each comprising a one-story cube having a second length and a second width that are the same, the second width and the second length being less than the first length, and the second and third tower sections configured to be stacked on top of one another and attached to the first main service section to comprise a multi-story tower contiguous with the first main service section and having a height greater than a height of the first main service section;

the first main service section and the second and third tower sections being sized to fit on a pair of tractor-trailer beds for delivery in a single-story disassembled configuration to the parking lot, each of the pair of tractor trailer beds having a third width corresponding to the first width and a third length corresponding to the first length; loading the first main service section on a first one of the pair of tractor trailer beds;

loading the second and third tower sections on a second one of the pair of tractor trailer beds;

delivering the first main service section and the second and third tower sections to the parking lot and assembling them into a modular building comprising the first main service section at a ground level and a multi-story tower section comprising the second and third tower sections stacked upon each other and having a height greater than a height of the first main service section, wherein the second tower section is contiguous with the first main service section at the ground level, and the third tower section is stacked upon the second tower section;

wherein the first main service section comprises steel frame/foundation members, one or more roof panels, exterior wall panels, and one or more floor panels;

wherein the second tower section comprises steel frame/foundation members, one or more ceiling panels, exterior wall panels, and one or more floor panels;

wherein the third tower section comprises one or more roof panels, and exterior wall panels;

wherein at least the exterior wall panels of the first main service section and the second and third tower sections are structural insulated panels; and wherein, in the assembled modular building the one or more ceiling panels of the second tower section define a floor of the third tower section.

2. The method of claim 1, further comprising anchoring the steel frame/foundation members of the modular building to the parking lot with anchor structures secured in concrete tube forms placed in holes drilled in the parking lot.

3. The method of claim 1, further comprising providing utilities to the modular building in the parking lot with directional bore utilities extending from a location outside the parking lot to the modular building.

4. The method of claim 1, further comprising:

pre-fabricating offsite a modular carport section comprising a roof and a side wall, the modular carport section further being configured to be connected to the first main service section to provide a covered drive-thru area adjacent a sidewall of the first main service section; and delivering the modular carport section to the parking lot and connecting it to the first main service section as part of the assembled modular building.

5. The method of claim 1, wherein the second tower section comprises a restroom module and the third tower section comprises an utility module.

6. The method of claim 1, wherein the third tower section comprises four exterior wall panels comprising flat surfaces and business signage located on one or more of the four exterior wall panels, and wherein, in the assembled modular building, the business signage is elevated above a roof portion of the first main service section.

7. The method of claim 1, wherein the parking lot is shared by a retail business.

8. The method of claim 1, wherein pre-fabricating offsite the first main service section and the second and third tower sections further comprises at least substantially finishing interior spaces of the first main service section and the second and third tower sections for use in conducting a retail business.

9. The method of claim 8, wherein at least substantially finishing interior spaces of the first main service section and the second and third tower sections includes installing equipment selected from one or more of a stove, an oven, a refrigerator, a freezer, a sink, a dishwasher, a computer, a cash register/terminal, a coffee-brewing machine, a drive-thru order taking system, and a display board.

10. The method of claim 1, wherein the first main service section comprises at least one drive-through service window.

11. The method of claim 10, further comprising:

pre-fabricating offsite a modular carport section comprising a roof and a side wall, the modular carport section further being configured to be connected to the first main service section to provide a covered drive-thru area adjacent the at least one drive-through service window of the first main service section; and delivering the modular carport section to the parking lot and connecting it to the first main service section as part of the assembled modular building.

* * * * *